US007766306B2

(12) United States Patent
Morey

(10) Patent No.: US 7,766,306 B2
(45) Date of Patent: Aug. 3, 2010

(54) DEVICE FOR REMOVING WHEEL END COMPONENTS AS AN ASSEMBLY ON VEHICLES WITH BALL JOINTS AND METHOD FOR SERVICING VEHICLE BALL JOINTS

(76) Inventor: Robert P. Morey, 1153 Highbridge Rd., Schenectady, NH (US) 12303

( * ) Notice: Subject to any disclaimer, the term of this patent is extended or adjusted under 35 U.S.C. 154(b) by 39 days.

(21) Appl. No.: 12/004,939

(22) Filed: Dec. 21, 2007

(65) Prior Publication Data

US 2009/0158570 A1 Jun. 25, 2009

(51) Int. Cl.
*B66C 23/00* (2006.01)

(52) U.S. Cl. ..... 254/28; 254/133 R; 254/134; 254/93 R; 29/252

(58) Field of Classification Search ..... 254/2 B, 254/93 R, 93 L, 8 B, 6 B, 133 R, 134; 29/252
See application file for complete search history.

(56) References Cited

U.S. PATENT DOCUMENTS 1,812,585 A * 6/1931 Collins ..... 269/59
4,490,897 A 1/1985 Forre
5,127,638 A * 7/1992 Kent ..... 269/17
5,378,004 A 1/1995 Gunlock et al.
5,505,578 A * 4/1996 Fuller ..... 414/427
5,711,512 A * 1/1998 Kauffman ..... 254/2 B
6,416,039 B1 * 7/2002 Pietrusynski ..... 254/8 B
6,457,700 B1 * 10/2002 Hong ..... 254/8 B
6,925,696 B1 8/2005 Williams
7,207,549 B2 * 4/2007 Crawford ..... 254/134
7,347,409 B2 * 3/2008 Goza ..... 254/2 B
2009/0158570 A1 * 6/2009 Morey ..... 29/252

* cited by examiner

*Primary Examiner*—Lee D Wilson
(74) *Attorney, Agent, or Firm*—Davidson, Davidson & Kappel, LLC

(57) ABSTRACT

A device for removing a vehicle wheel end assembly includes a base having an upright section; and a hub support movable with respect to the upright section, the hub support having a first section translatable with respect to the upright section, and a hub adaptor pivotally connected to the first section so as to permit the hub adaptor to be angled with respect to the first section. A method for servicing ball joints of a motor vehicle includes jacking the motor vehicle so that a wheel is off the ground; removing a wheel from a wheel hub; removing the wheel end assembly including the wheel hub from the vehicle having ball joints using a device supporting the entire wheel end assembly; and servicing the ball joints of the motor vehicle.

16 Claims, 4 Drawing Sheets

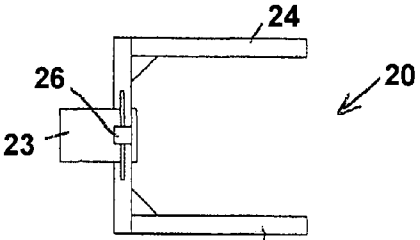
Fig. 3a
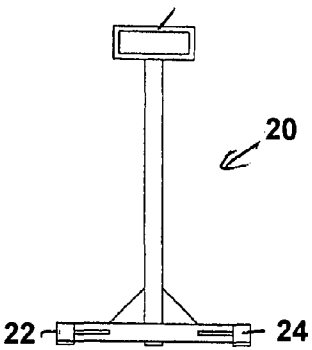
Fig. 3b
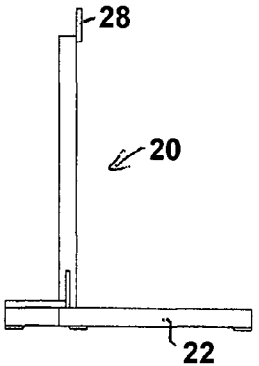
Fig. 3c
Fig. 3d
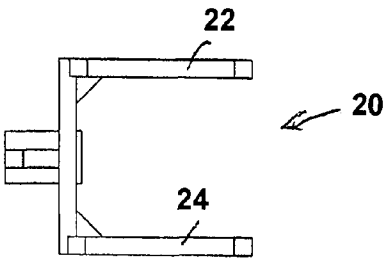
Fig. 3e

DEVICE FOR REMOVING WHEEL END COMPONENTS AS AN ASSEMBLY ON VEHICLES WITH BALL JOINTS AND METHOD FOR SERVICING VEHICLE BALL JOINTS

The present invention relates to a device for removing wheel end components as an assembly on vehicles with ball joints, and to a method for servicing vehicle ball joints.

BACKGROUND

U.S. Pat. No. 5,127,638 describes an apparatus for removing wheel hubs from vehicle axes. Adjustable tubular sockets receive varying spaced lift forks.

U.S. Pat. No. 5,378,004 discloses a device for removing a brake drum and hub assembly, having a hand truck and a jack.

Both of these patents are hereby incorporated by reference herein, but are for use with larger trucks typically employing king pins to attach the hub assembly to the vehicle.

Certain vehicles, such as Ford E-150, 250, 350, 450 and Super Duty series vans and F-150, 250, 350, 450 and Super Duty series pick-up trucks, use twin I-beam front axles with ball joints in the steering knuckle that attach the hub assembly to the vehicle axle.

Ball joint replacement or repair typically is a very time consuming process requiring disassembly and removal of brake calipers and other components. Also, the ball joints in the steering knuckle are set at adjustable angles, so that the hub is also at an angle to the I-beam. Each vehicle thus can have a different hub angle.

SUMMARY OF THE INVENTION

Due to the different hub angles, it has been found that aforementioned devices similar to those in U.S. Pat. Nos. 5,127,638 and 5,378,004 generally are not suitable for use in replacing ball joints, as the hub angle is difficult to deal with.

An object of the present invention is to provide a device for easily removing wheel end assemblies on vehicles with ball joints and a method for more easily replacing vehicle ball joints.

The present invention provides a device for removing a vehicle wheel end assembly comprising:

a base having an upright section; and a hub support movable with respect to the upright section, the hub support having a first section translatable with respect to the upright section, and a hub adaptor pivotally connected to the first section so as to permit the hub adaptor to be angled with respect to the first section.

The present invention also provides a method for servicing ball joints of a motor vehicle comprising:

jacking the motor vehicle so that a wheel is off the ground;

removing a wheel from a wheel hub;

removing the wheel end assembly including the wheel hub from the vehicle having ball joints using a device supporting the entire wheel end assembly; and servicing the ball joints of the motor vehicle.

BRIEF DESCRIPTION OF THE DRAWINGS

One preferred embodiment of the present invention is described with relation to the following drawings, in which:

FIGS. 3*a*, 3*b*, 3*c*, 3*d* and 3*e* shows the top, back, side, front and bottom views of the base of the wheel end assembly removal device of FIG. 2.

DETAILED DESCRIPTION

Figure 1:
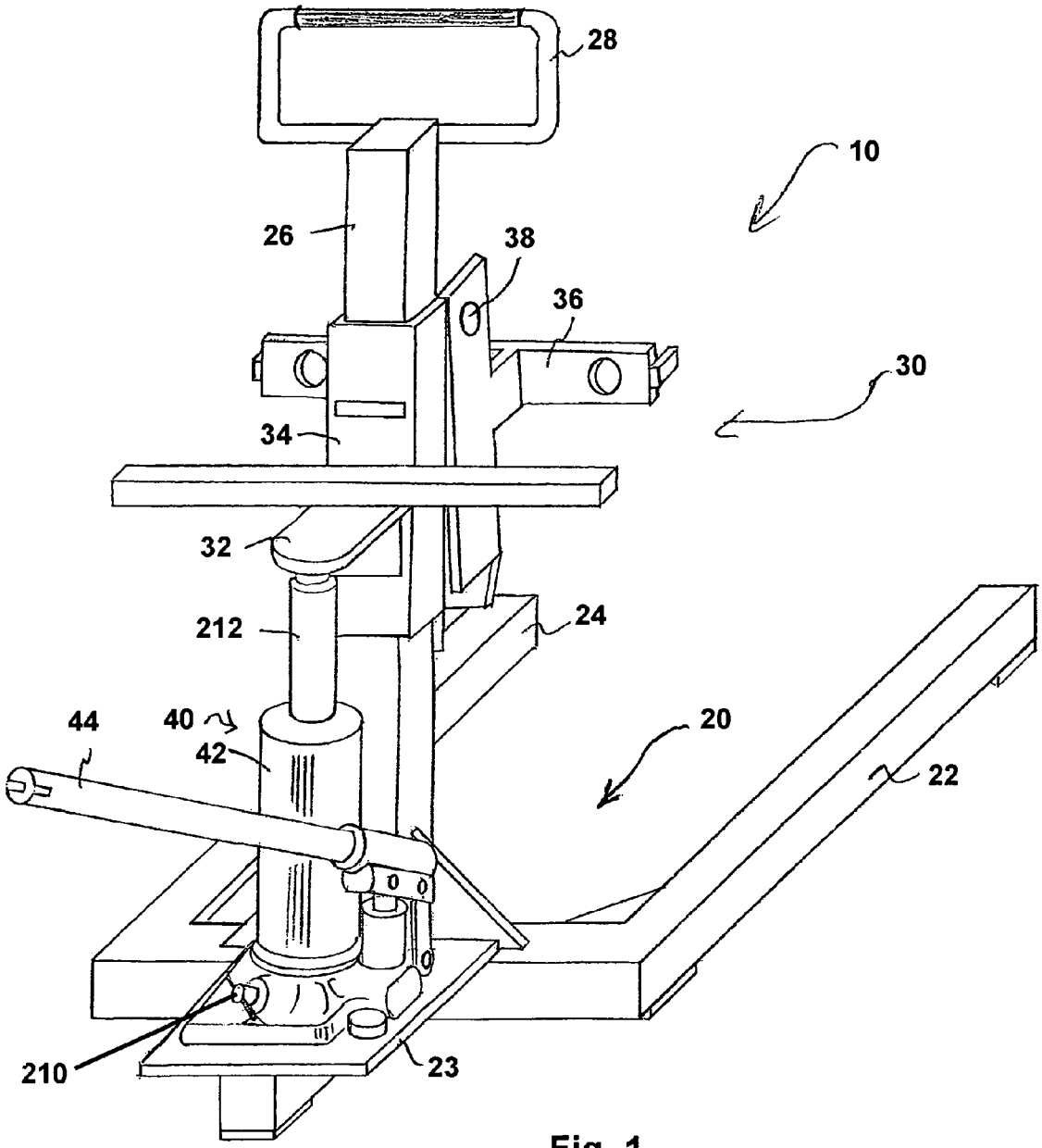
FIG. 1 is a perspective view of one embodiment of the wheel end assembly removal device of the present invention.

FIG. 1 shows a perspective view of a wheel end assembly removal device 10 of the present invention. Hub removal device 10 has a base 20, on which a hub support 30 is movable supported. Base 20 has a pair of legs 22, 24 which can rest on the ground, as well as an upright section 26, for example having a rectangular or square hollow cross section. A handle 28 can be provided at the top of upright section 26. Hub support 30 slides along upright section 26, and can be moved via a jack 40 with a pneumatic or hydraulic cylinder 42 actuable via a jack handle 44. Cylinder 40 can have a piston rod 46 connectable to hub support 30 via a height adjuster screw 212. A bottom of cylinder 42 can rest on a plate 23 of base 20.

Hub support 30 may have a piston rod connector 32 resting on screw 212, a first section 34 which may be a hollow slide, and a hub adaptor 36 attached pivotally to the hollow slide 34 via a pivot 38.

Figure 2:
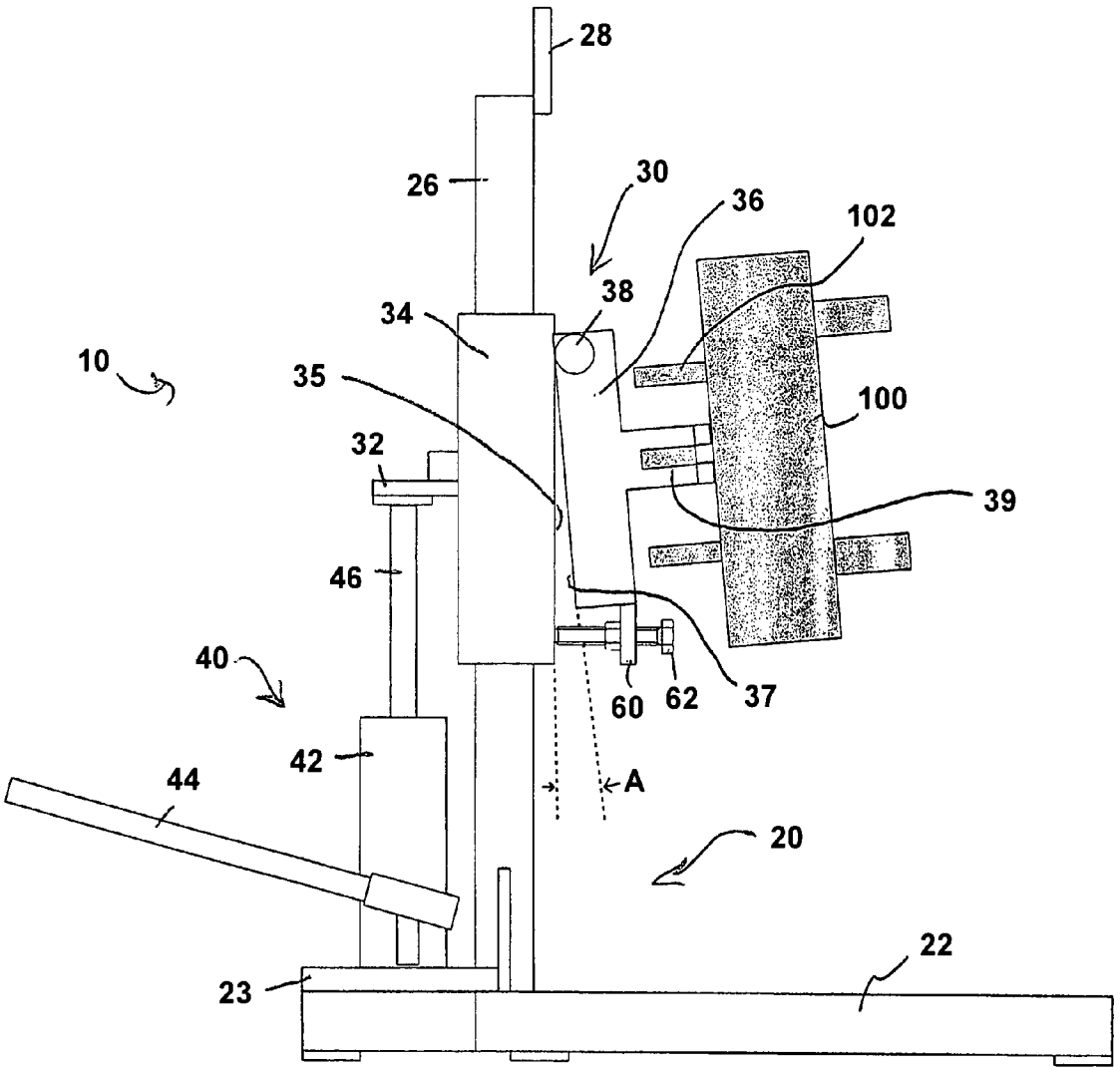
FIG. 2 is a side view of the wheel hub removal device of the present invention holding a wheel end assembly of a vehicle.

FIG. 2 shows a side view of the FIG. 1 device 10 holding a wheel end assembly 100, including a wheel hub and brake calipers. An adjustment screw 62 can fit in a threaded hole of an extension 60 of hub adaptor 36. Adjustment screw 62 can be used to set an angle A between surface 35 of first section 34 and surface 37 of hub adaptor 36. The angle at which hub adaptor holes 39 approach the lugs 102 of wheel end assembly 100 thus can be varied. Varying hub angles on vehicles having ball joints thus can addressed in an effective manner.

FIGS. 3*a*, 3*b*, 3*c*, 3*d* and 3*e* shows the top, back, side, front and bottom views of base 20 of the wheel hub removal device of FIG. 2, the numbering being similar as in FIG. 1.

Figure 4C:
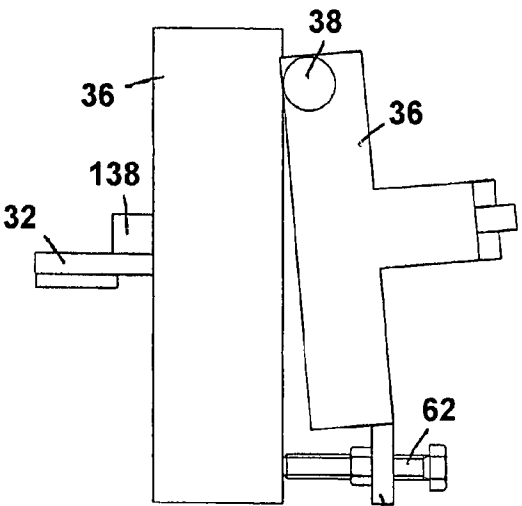
FIGS. 4*a*, 4*b* and 4*c* show a top, front and side view of the hub support of the wheel end assembly removal device of FIG. 2 and slidable on the base support.
Figure 4A:
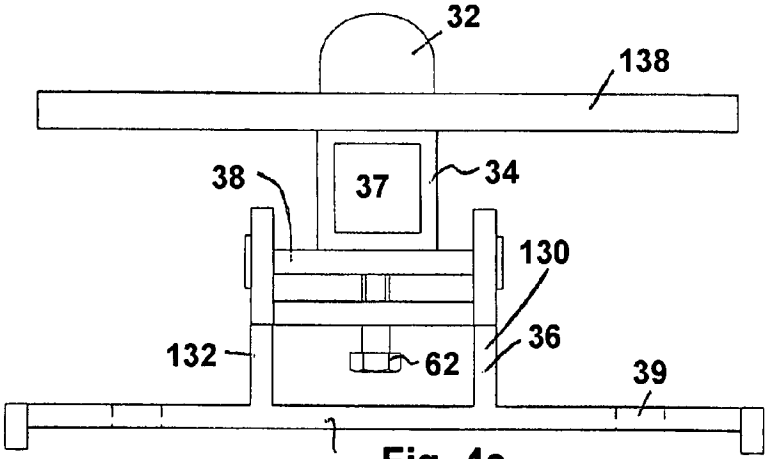
Figure 4B:
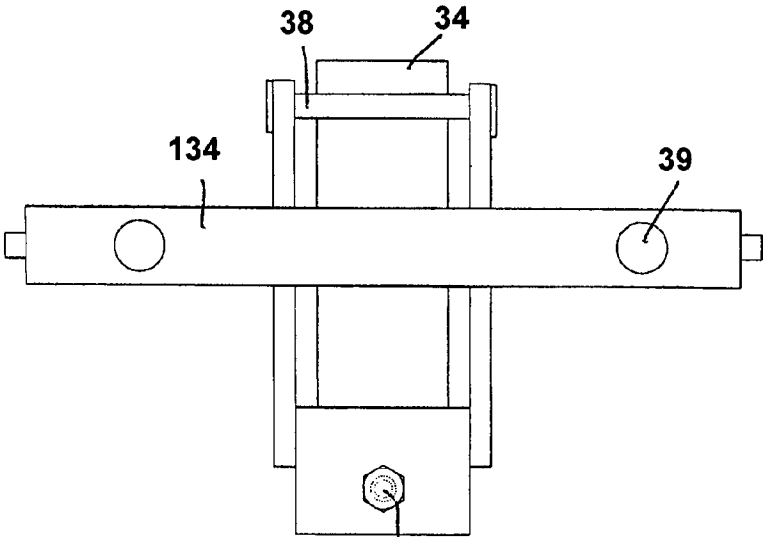

FIGS. 4*a*, 4*b* and 4*c* show a top, front and side view of the hub support 30 of the hub removal device of FIG. 2. As shown in FIG. 1 and FIG. 4*a*, first section 34 can slide vertically up and down on upright section 26 via jack 40. First section 34 thus can have an interior hole 37 into which upright section 26 can fit. Pivot 38 can be attached to first section 34, for example via welding, and hub adaptor 36 may have two arms 130, 132 and a cross bar 136.

A further handle 138 may be attached to connector 32 as well.

The spacing of holes 39 preferably is designed to fit Ford E-150, 250, 350, 450 and Super Duty series vans and F-250, 350, 450 and Super Duty series pick-up trucks An adaptor cross bar, for example for Ford F-150 pick-up trucks, can be provided to attach to cross bar 134 and provide different hole spacing.

The present invention also provides a preferred method for replacing ball joints, and one most preferred method may include the following steps:

1. Raise and support vehicle using a separate jack to provide one inch of clearance below tire.

2. Remove lug nuts and tire/wheel assembly.

3. Remove cotter pin and castle nut from the outer tie rod, remove the tie rod from the spindle arm.

4. Remove the cotter pin and castle nut from the lower ball joint.

5. Remove the plugs or grease fittings from both ball joints.

6. By hand, slide hub support 30 upward and attach to the wheel hub. Use two lug nuts (removed in step 2) for attachment so that they are snugly tightened but not overtorqued.

7. Close down valve 210 on jack 40, which may be a bottle jack, and pump cylinder 42 up three inches. Use height adjuster screw 212 to close the gap between bottle jack 40 and sliding hub support 30. Turn angle adjusting screw 62 to set angle A of hub adaptor 36. Open down valve 210 on bottle jack 40, one turn.

8. Pivot device 10 and wheel hub assembly 100 toward the rear of vehicle, to the steering stop.

9. Remove pinch bolt from the axle at the upper ball joint.

10. Separate lower ball joint from axle, wheel end components will lower and be supported by the device 11. Slide the device 10 out and rearward to gain access to the inner end of the spindle of the vehicle, being careful not to stress the brake hose or A.B.S. wires.

12. Close down valve 210 on bottle jack 40 and raise the hub support 30/wheel end assembly 100 to the top of the stroke.

13. Turn the vehicle spindle assembly ninety degrees (brake caliper at bottom) to gain access to ball joints.

14. Using an appropriate ball joint press, remove the lower ball joint and then the upper ball joint.

15. Using a putty knife and wire brush, clean old grease and dirt from inner spindle and axle areas.

16. Using an appropriate ball joint press, install the upper ball joint and then the lower ball joint. Install dust seals on both ball joints. Preferably, this includes installing new upper and lower balls joints, so that the ball joints are replaced.

17. Turn spindle ninety degrees (brake caliper back to its original position) and open down valve 210 to lower hub support 30/wheel end assembly 100.

18. Slide device 10 in and forward to line up ball joint studs with mating holes in axle end.

19. Close the down valve on the bottle jack 40 and raise sliding hub support 30/wheel end assembly 100. Use angle adjuster bolt to align ball joint studs in axle holes and prevent binding, without forcing the ball joint studs.

20. Install castle nut, finger tight on the lower ball joint.

21. Open down valve 210 on the bottle jack 40 and remove the device 10 from the wheel hub. Push the sliding hub support 30 down into its storage position.

22. Torque the castle nut on lower ball joint and install the cotter pin.

23. Install and torque the pinch bolt in the axle at the upper ball joint.

24. Install grease fittings in both of the ball joints.

25. Reinstall tie rod end into spindle arm. Install and torque castle nut on tie rod stud and install the cotter pin.

26. Lube all components which have been replaced or disturbed.

The present embodiments are merely exemplary, and the scope of the invention is defined by the claims herein. Screw as defined herein includes a bolt or any other threaded device.

What is claimed:

1. A device for removing a vehicle wheel end assembly comprising:

a base having an upright section and a plate;

a jack including a handle and a housing with a piston wherein said jack is connected to said plate;

and a hub support movable with respect to the upright section, the hub support having a first section translatable with respect to the upright section, and a hub adaptor including an elongated member having at least two apertures with said elongated member extending transverse to said upright section of said base and an extension member connected to said elongated member with said extension member being substantially parallel to said upright section of the base pivotally connected to a pivot member of the first section so as to permit the hub adaptor to be angled with respect to the first section wherein said extension member has an adjustable screw threading through said extension member causing said hub adaptor to adjust angularly with respect to said base upright section, the hub adaptor including a connection to the vehicle wheel end assembly.

2. The device as recited in claim 1 further comprising an angle adjustor connecting the hub adaptor to the first section.

3. The device as recited in claim 2 wherein the angle adjustor include a screw.

4. The device as recited in claim 3 wherein the hub adaptor has a hole, the screw fitting within the hole and contacting against first section.

5. The device as recited in claim 1 further comprising a jack moving the hub support with respect to the base.

6. The device as recited in claim 1 wherein the base includes at least two legs.

7. The device as recited in claim 1 wherein the connection includes a cross support with at least two lug holes.

8. A method for servicing ball joints of a motor vehicle comprising:

jacking the motor vehicle so that a wheel is off the ground;

removing a wheel from a wheel hub;

removing a wheel end assembly including the wheel hub from the vehicle having ball joints using a device supporting the wheel end assembly;

servicing the ball joints of the motor vehicle; and said jack having a base having an upright section and a plate;

a jack including a handle and a housing with a piston wherein said jack is connected to said plate;

and a hub support movable with respect to the upright section, the hub support having a first section translatable with respect to the upright section, and a hub adaptor including an elongated member having at least two apertures with said elongated member extending transverse to said upright section of said base and an extension member connected to said elongated member with said extension member being substantially parallel to said upright section of the base pivotally connected to a pivot member of the first section so as to permit the hub adaptor to be angled with respect to the first section wherein said extension member has an adjustable screw threading through said extension member causing said hub adaptor to adjust angularly with respect to said base upright section, the hub adaptor including a connection to the vehicle wheel end assembly.

9. The method as recited in claim 8 further comprising adjusting an angle of a hub adaptor of the device.

10. The method as recited in claim 8 further comprising rotating the device and the wheel end assembly after the removing step and before the replacing step.

11. The method as recited in claim 8 wherein the servicing of the ball joints includes replacing the ball joints.

12. The method as recited in claim 8 wherein the jacking includes using a jack separate from the device supporting the wheel assembly.

13. The method as recited in claim 8 further comprising removing a cotter pin and a castle nut from the vehicle before the removing step.

14. The method as recited in claim 8 further comprising removing plugs or grease fittings from the balls joints before the removing step.

15. The method as recited in claim 8 wherein the servicing the ball joints includes removing the ball joints, cleaning grease from an inner spindle area, and replacing the ball joints.

16. A method for servicing ball joints of a motor vehicle:

jacking the motor vehicle so that a wheel is off the ground;

removing a wheel from a wheel hub;

removing a wheel end assembly including the wheel hub from the vehicle having ball joints using the device; having a base having an upright section and a plate;

a jack including a handle and a housing with a piston wherein said jack is connected to said plate;

and a hub support movable with respect to the upright section, the hub support having a first section translatable with respect to the upright section, and a hub adaptor including an elongated member having at least two apertures with said elongated member extending transverse to said upright section of said base and an extension member connected to said elongated member with said extension member being substantially parallel to said upright section of the base pivotally connected to a pivot member of the first section so as to permit the hub adaptor to be angled with respect to the first section wherein said extension member has an adjustable screw threading through said extension member causing said hub adaptor to adjust angularly with respect to said base upright section, the hub adaptor including a connection to the vehicle wheel end assembly;

and servicing the ball joints of the motor vehicle.

* * * * *